US005706983A

United States Patent [19]

Dobbs et al.

[11] Patent Number: 5,706,983

[45] Date of Patent: Jan. 13, 1998

[54] TRIGGER SPRAYER HAVING A NOZZLE COVER

[75] Inventors: Douglas B. Dobbs, Yorba Linda; Adonis K. Spathias, Corona, both of Calif.

[73] Assignee: Calmar Inc., City of Industry, Calif.

[21] Appl. No.: 516,559

[22] Filed: Aug. 18, 1995

[51] Int. Cl.[6] ..... B67B 5/00

[52] U.S. Cl. ..... 222/153.14; 222/136; 222/383.1

[58] Field of Search ..... 222/153.14, 135, 222/136, 137, 383.1, 556

[56] References Cited

U.S. PATENT DOCUMENTS

| | | |
|---|---|---|
| 3,650,473 | 3/1972 | Malone . |
| 4,155,203 | 5/1979 | Tada . |
| 4,506,805 | 3/1985 | Marcon . |
| 4,606,480 | 8/1986 | Gazulla . |
| 4,815,663 | 3/1989 | Tada . |
| 4,958,754 | 9/1990 | Dennis . |
| 5,114,049 | 5/1992 | Knickerbocker . |
| 5,158,233 | 10/1992 | Foster . |
| 5,358,130 | 10/1994 | Mengeu et al. . |
| 5,373,991 | 12/1994 | Nelson . |
| 5,385,302 | 1/1995 | Foster et al. . |

*Primary Examiner*—Gregory L. Huson

*Attorney, Agent, or Firm*—Watson Cole Stevens Davis, P.L.L.C.

[57] ABSTRACT

A trigger actuated pump sprayer has a nozzle cover for sealing the discharge orifice closed against leakage by the provision of a cup-shaped element on the cover which telescopes about a nosepiece in which the orifice is formed and fluid tightly engages a seal ring extending laterally outwardly of the nosepiece in the closed position of the cover. The cover is locked in its closed position and is rendered child-resistant by the provision of at least one resilient lock pin extending through an opening in the sprayer housing requiring an inward depression of the lock pin with one hand and a flipping open of the cover with the other hand.

23 Claims, 3 Drawing Sheets

10
11
12
13
14
15
16
17
18
19
21
22
23
24
25
26
27
28
29
31
32
34
35
36
37
38
39
41
42
43
44
45
46
47
54
4

54
48
53
56
47
45
43
42
16
39
41
17
51
49

TRIGGER SPRAYER HAVING A NOZZLE COVER

BACKGROUND OF THE INVENTION

This invention relates generally to trigger sprayers, and more particularly to a nozzle assembly for the trigger sprayer having a cover hinged for movement between a discharge uncovered position and a discharge covered position in which the discharge orifice may be sealed against leakage during conditions of non-use, and in which the cover may be locked in place. In the looked position, provision is made for rendering the cover child-resistant.

Trigger sprayers having hinged covers for sealing the discharge orifice closed against leakage offer a variety of known structures. For example, a sealing pin or knob on the cover has been provided for bearing directly against the discharge orifice in the door closed position. Such a seal arrangement, however, is undesirable as the pin or knob tends to distort the orifice upon repeated closing operations of the cover, thereby affecting the quality of spray through the orifice.

Otherwise, a cylindrical projection on the cover has been arranged to plug into a circular skirt located downstream of the discharge orifice in the cover closed position. Although the projection is spaced from the discharge orifice in the closed position, it is difficult to obtain a liquid tight seal with such arrangement.

Moreover, hinged doors of various types throughout the art for covering the discharge orifice of a trigger sprayer, whether or not providing a seal, are capable of being locked in the closed position using some type of detent or snapping action requiring a single step unlocking or unlatching operation. The cover or door can therefore be unlocked by a child, presenting an undesirable or unsafe condition when the contents are sprayed upon trigger actuation.

SUMMARY OF THE INVENTION

It is therefore an object of the present invention to provide a trigger sprayer having a hinged cover which in the discharge covered position provides a fluid tight seal for the discharge orifice during shipping and other conditions of non-use, and/or is locked in place in a manner requiring a two-hand unlocking operation to render the locked cover child resistant.

The discharge orifice is located in an end wall of a nosepiece having a cylindrical upstream extending sidewall, and a laterally extending circular seal ring on the nosepiece. The cover has a cylindrical sidewall telescoped about the nosepiece for fluid tightly engaging the seal ring in the closed position of the cover for sealing the orifice closed against leakage.

The child-resistant feature of the invention includes the provision of at least one laterally extending lock pin on the cover engageable with an opening in a flange on the nozzle assembly in a manner providing a snap lock to be unlocked by inwardly depressing the pin and lifting the cover.

Other objects, advantages and novel features of the invention will be come more apparent from the following detailed description of the invention when taken in conjunction with the accompanying drawings.

DETAILED DESCRIPTION OF THE INVENTION

Figures 1, 2:
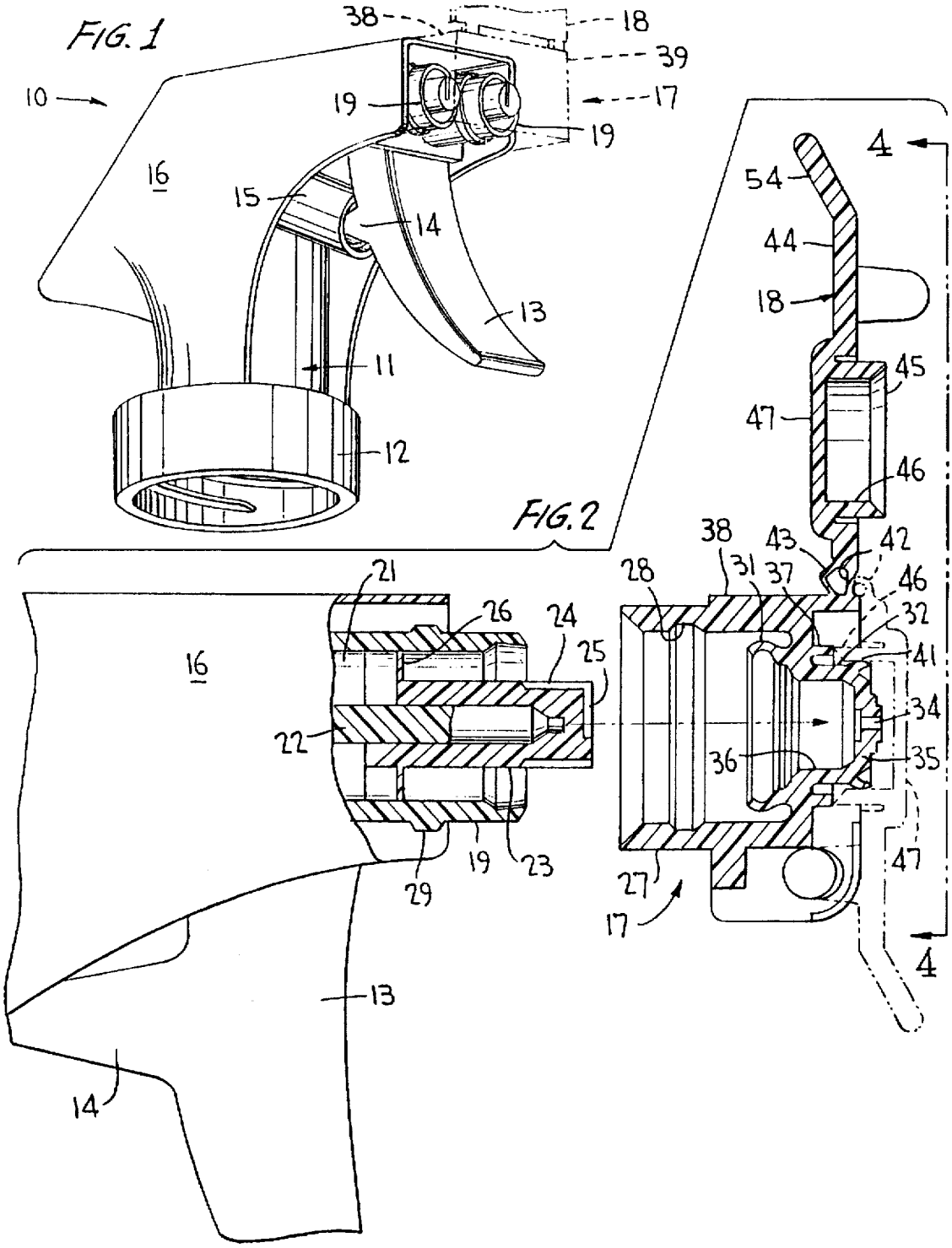
FIG. 1 is a perspective view of a trigger sprayer incorporating the invention shown in phantom outline.
FIG. 2 is a side view, at an enlarged scale, of the trigger sprayer partly in section together with a disassembled showing of the nozzle assembly in section.
Figure 3:
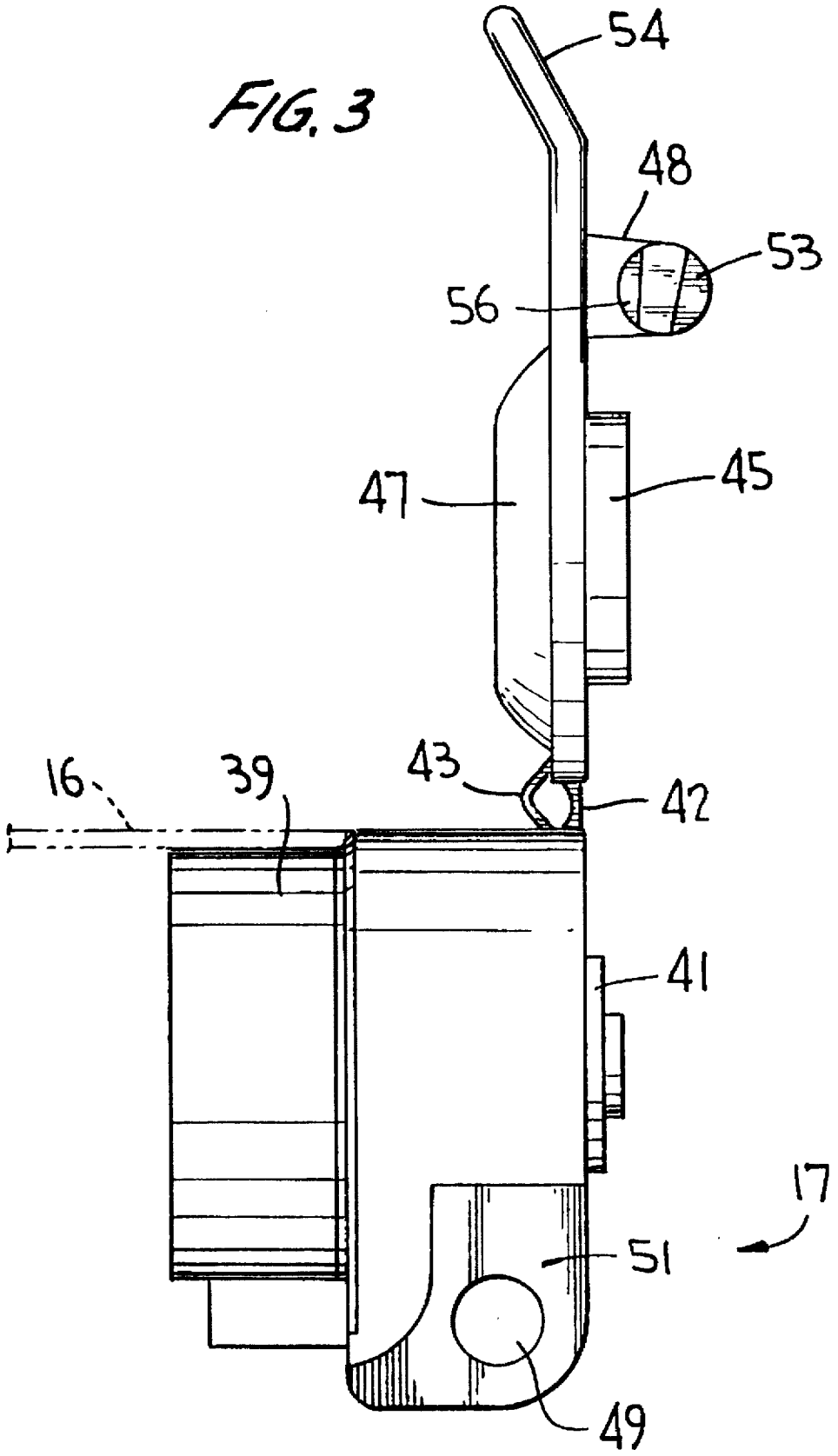
FIG. 3 is a side elevational view of the nozzle assembly and cover according to the invention with the cover shown in its open position.

Turning now to the drawings wherein like reference characters refer to like and corresponding parts throughout the several views, trigger sprayer 10 of FIG. 1 is shown as a dual discharge pump sprayer having a housing 11 to which a container closure 12 is connected for mounting the sprayer to a container (not shown) of liquid in divided liquid compartments for being simultaneously discharged as separate sprays upon actuation of trigger lever 13. As in a single discharge trigger sprayer, tups 14 (only one shown) of lever 13 transmit the force applied upon trigger actuation to pump pistons (not shown) reciprocating within pump cylinders 15 for effecting the spray. The details of the pump structure are known and are otherwise not specified here. A shroud 16 covers the housing.

Nozzle assembly 17 shown in phantom outline in FIG. 1 includes a connected nozzle cover 18, and is shown in more detail in FIGS. 2–6. The invention is not restricted to the dual sprayer of FIG. 1, but is likewise adaptable for any single discharge trigger sprayer and will accordingly be described in detail for a single discharge trigger sprayer, for the sake of clarity.

Discharge barrel 19 of the sprayer forms a discharge passage 21 and includes a fixed probe 22 supporting an insert 23 having a closed downstream end having a reduced diameter portion 24 forming a fluid passage into a swirl chamber via tangential channels 24 for producing a swirl of the liquid before issuing through discharge orifice 34 in the form of a fine mist spray. A conventional discharge flap valve 26 may be provided although such a valve is not necessary in keeping with the invention.

The nozzle assembly 17 includes a nozzle cap 27 having an internal groove 28 to facilitate snap-fit engagement with an external rib 29 on the discharge barrel. When assembled on the discharge barrel, annular flange 31 seals against the inner wall of the discharge barrel, and insert 23 projects into nosepiece 32 such that the downstream end of insert 23 bears against a confronting inner surface of end wall 35 of the nosepiece.

End wall 35 of the nosepiece contains discharge orifice 34, the nosepiece further comprising a cylindrical sidewall 36 extending in an upstream direction. An outer downstream directed short skirt 37 surrounds the nosepiece, as detailed in FIG. 2.

Spin mechanics may otherwise be formed on the inner surface of end wall 35 including tangential channels and a swirl chamber, rather than at the end of insert 23, is known in the art, for effecting a fine mist spray through the orifice upon trigger actuation.

The nozzle assembly includes an upper wall 38, opposed sidewalls 39, and a front wall 40 (FIGS. 3 and 4), and the upper and sidewalls may form extensions of the adjacent upper and opposed sidewalls of shroud 16 (FIG. 1). The nozzle cap, or caps, form a unit integrally molded with walls 38, 39.

The nosepiece has a laterally extending circular seal ring 41, concentric with discharge orifice 34, which may be in the form of a conical chevron seal diverging outwardly as shown, or may be in the form of an annular seal bead.

Nozzle cover 18 is connected by hinge straps 42 to upper wall 38, which upper wall 38 becomes part of the pump housing when affixed thereto. The hinged connection may be additionally formed by a known over-the-center knee joint or joints 43 which retains the cover in its upwardly extending open position shown in FIGS. 2 and 4.

Figure 5:
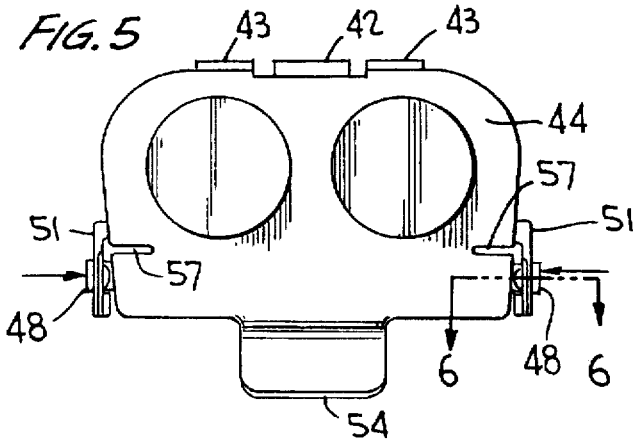
FIG. 5 is a front elevational view, at a reduced scale, showing the cover of the invention in its closed and locked position.

Cover 18 is in the form of a flap 44 which may be outwardly dimensioned to conform to the profile of walls 38, 39 when the cover is moved to its nozzle closing position of FIG. 5.

Flap 44 has cup-shaped portions 45 each presenting a cylindrical sidewall 46 and a bottom wall 47. Of course, for a single discharge sprayer, flap 44 has a single cup-shaped portion 45 which functions in the manner as will be described.

As shown in phantom outline in FIG. 2, when cover 18 is moved to its nozzle closed position, sidewall 46 telescopes about the nosepiece and forms a liquid tight seal upon engagement with seal ring 41. The inner surface of flap 44 bears against the outer edges of walls 38, 39 in the cover closed position, and the free edges of portions 45 bear against the free edges of skirts 37, as shown in phantom outline in FIG. 2. And in this cover closed position, bottom wall 47 is slightly spaced from the discharge orifice.

In the phantom outline position of the cover shown in FIG. 2, the discharge orifice(s) is sealed closed against leakage during shipping and storage and in other conditions of non-use of the trigger sprayer.

Figure 4:
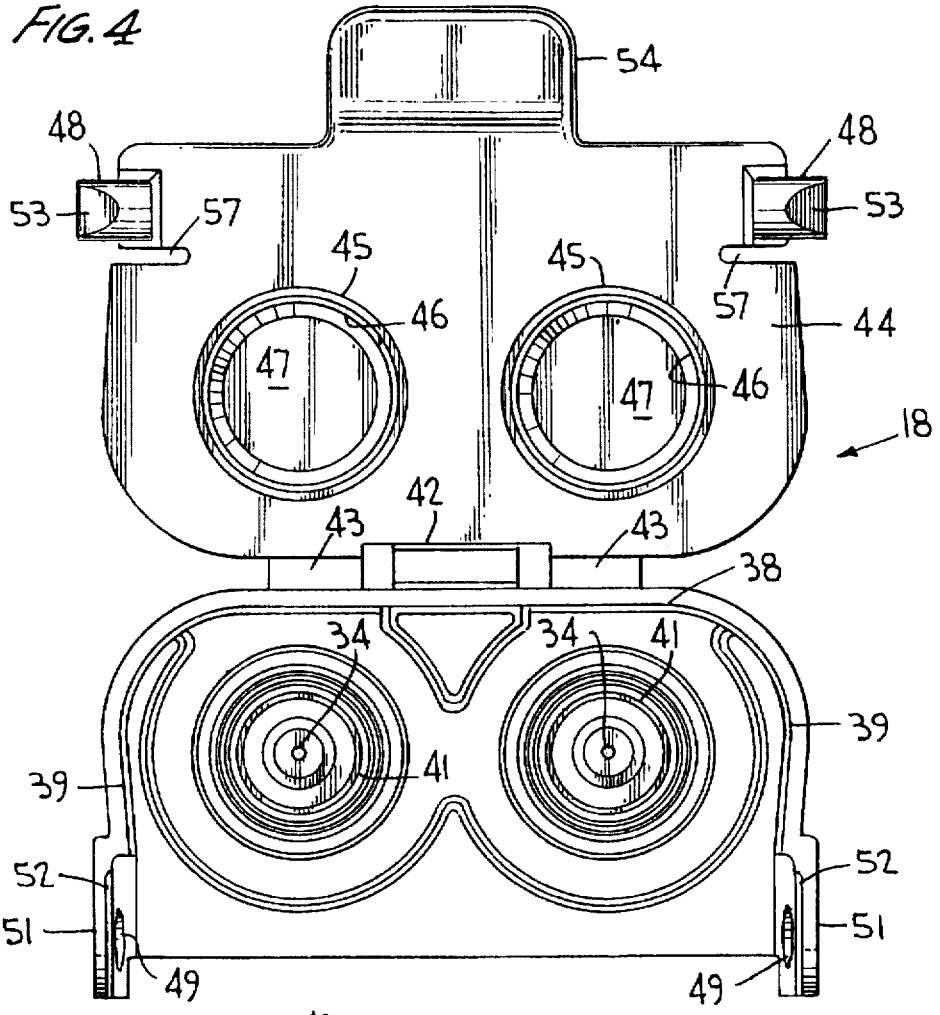
FIG. 4 is a plan view taken substantially along the line 4—4 of FIG. 2.

In accordance with another feature of the invention, cover 18 is capable of being locked in its closed position of FIGS. 2 and 5. For this purpose, flap 44 has at least one lock pin 48 (two lock pins 48 are shown in FIGS. 4 and 5) extending outwardly in a lateral direction for engagement with an opening 49 located in a flange 51 depending from sidewall 39. An inner edge of the flange is chamfered as at 52 and a confronting edge of the lock pin is chamfered as at 53. Thus, flap 44 is locked in its nozzle closed position as the or each lock pin 48 snaps into engagement with opening 49 as assisted by chamfered edge 53 which slides along chamfered edge 52 in the process of closing the cover. An outwardly extending finger tab 54 on flap 44 may be provided to facilitate manual movement of the cover between its open and closed positions.

Figure 6:
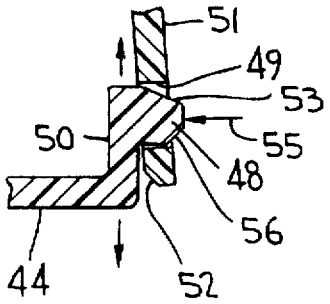
FIG. 6 is a sectional view, at an enlarged scale, taken substantially along the line 6—6 of FIG. 5.

As shown in FIG. 6, lock pin 48 extends through opening 49 slightly beyond the outer face of flange 51. To unlock the flap, inwardly directed finger pressure is applied against lock pin 48 (inward squeezing pressure is applied against both lock pins) in the direction of arrow 55 to at least partially unseat the lock pin from opening 44 permitting the flap to be moved toward its open position of FIGS. 2 and 4 by grasping finger tab 54 with the other hand to flip the flap open about its hinge. To assist in unseating lock pin 48 from its opening 49 in the process of pressing inwardly against the lock pin or pins, each pin may be chamfered at the back surface thereof as at 56. Thus, the locked cover according to the invention is rendered child-resistant in that one hand of the operator is required to depress lock pins 48 inwardly and the other hand is required to lift the flap.

The lock pins are resiliently formed on the cover as by the provision of spring legs 50 which may be delimited by open grooves 57 to impart resiliency to the lock pins during the snap-lock engagement with openings 49 and upon manual inward pressure applied in the direction of arrow 55 during the unlocking procedure.

It can be seen that a simple and economical yet highly effective nozzle cover has been provided for sealing the discharge orifice closed against leakage in the covered position, and providing a nozzle cover lock which can be rendered child-resistant.

Obviously, many other modifications and variations of the present invention are made possible in the light of the above teachings. It is therefore to be understood that within the scope of the appended claims, the invention may be practiced otherwise than as specifically described.

What is claimed is:

1. A trigger actuated pump sprayer, comprising a housing having a first passage in communication with a first liquid source and terminating in a first discharge orifice located in a first end wall, a cover hingedly connected to said housing for movement between an orifice uncovered position and an orifice covered position, a first cylindrical sidewall extending upstream from said end wall and defining a first nosepiece together therewith, a first laterally extending circular seal ring on said nosepiece, and said cover having a first cup-shaped portion presenting a first cylindrical sidewall telescoped about said nosepiece forming a liquid tight seal with said seal ring in said covered position for sealing the discharge orifice closed, said cover sidewall having a bottom wall spaced from said orifice in said covered position.

2. A trigger actuated pump sprayer, comprising a housing having a first discharge passage in communication with a first liquid source and terminating in a first discharge orifice located in a first end wall, a cover hingedly connected to said housing for movement between an orifice uncovered position and an orifice covered position, said cover being connected to said housing by an over-the-center knee joint for urging said cover into the uncovered position, a first cylindrical sidewall extending upstream from said end wall and defining a first nosepiece together therewith, a first laterally extending circular seal ring on said nosepiece, and said cover having a first cup-shaped portion presenting a first cylindrical sidewall telescoped about said nosepiece forming a liquid tight seal with said seal ring in said covered position for sealing the discharge orifice closed.

3. A trigger actuated pump sprayer, comprising a housing having a first discharge passage in communication with a first liquid source and terminating in a first discharge orifice located in a first end wall, a cover hingedly connected to said housing for movement between an orifice uncovered position and an orifice covered position, a first cylindrical sidewall extending upstream from said end wall and defining a first nosepiece together therewith, a first laterally extending circular seal ring on said nosepiece, said seal ring comprising an annular downstream extending chevron seal diverging outwardly of said nosepiece, and said cover having a first cup-shaped portion presenting a first cylindrical sidewall telescoped about said nosepiece forming a liquid tight seal with said seal ring in said covered position for sealing the discharge orifice closed.

4. A trigger actuated pump sprayer, comprising a housing having a first discharge passage in communication with a first liquid source and terminating in a first discharge orifice located in a first end wall, a cover hingedly connected to said housing for movement between an orifice uncovered position and an orifice covered position, a first cylindrical sidewall extending upstream from said end wall and defining a first nosepiece together therewith, a first laterally extending circular seal ring on said nosepiece, and said cover having a first cup-shaped portion presenting a first cylindrical sidewall telescoped about said nosepiece forming a liquid tight seal with said seal ring in said covered position for sealing the discharge orifice closed, said housing having a second discharge passage in communication with a second source and terminating in a second discharge orifice located in a second end wall, a second cylindrical sidewall extending upstream from said second end wall and defining a second nosepiece together therewith, a second laterally extending seal ring on said second nosepiece, and means on said cover telescoped about said second nosepiece in sealing engagement with said second seal ring in said covered position.

5. The sprayer according to claim 4, wherein said means on said cover comprises a second cup-shaped portion presenting a second cylindrical sidewall.

6. A trigger actuated pump sprayer, comprising a housing having a first discharge passage in communication with a first liquid source and terminating in a first discharge orifice located in a first end wall, a cover hingedly connected to said housing for movement between an orifice uncovered position and an orifice covered position, a first cylindrical sidewall extending upstream from said end wall and defining a first nosepiece together therewith, a first laterally extending circular seal ring on said nosepiece, and said cover having a first cup-shaped portion presenting a first cylindrical sidewall telescoped about said nosepiece forming a liquid tight seal with said seal ring in said covered position for sealing the discharge orifice closed, and means for locking said cover in said covered position comprising at least one laterally extending lock pin on said cover for engagement with at least one laterally extending opening in said housing.

7. The sprayer according to claim 6, wherein said cover has a finger tab for moving said cover between said covered and uncovered positions.

8. The sprayer according to claim 6, wherein said locking means comprise a pair of laterally extending lock pins extending outwardly of said cover respectively for engagement with a pair of laterally extending openings in said housing.

9. The sprayer according to claim 8, wherein said lock pins are resiliently connected to said cover permitting inward shifting movement of said pins in response to manual inward pressure applied thereto for at least partially disengaging said openings for unlocking said cover.

10. The sprayer according to claim 6, wherein said lock pin is resiliently connected to said cover permitting inward shifting movement of said pin in response to manual inward pressure applied thereto for at least partially disengaging said opening for unlocking said cover.

11. The sprayer according to claim 10, wherein said cover has a finger tab to enable the cover to be manually pivoted toward said uncovered position upon unlocking.

12. A trigger actuated pump sprayer, comprising a housing having a first discharge passage in communication with a first liquid source, and terminating in a first discharge orifice located in a first end wall, a cover hingedly connected to said housing for pivotal movement between an open position away from the path of said orifice and a closed position covering said orifice, means for locking said cover in said closed position comprising at least one laterally extending lock pin resiliently connected to said cover for snap-lock engagement with at least one laterally extending opening in at least one flange extending from said housing.

13. The sprayer according to claim 12, wherein said cover has an outwardly extending finger tab to facilitate manual movement of said cover between said open and closed positions.

14. The sprayer according to claim 12, wherein said housing further has a second discharge passage in communication with a second source, and terminating in a second discharge orifice located in a second end wall.

15. The sprayer according to claim 12, wherein said lock pin projects beyond an outer surface of said flange in said closed position permitting disengagement with said opening upon application of inward finger pressure applied to said pin.

16. The sprayer according to claim 15, wherein said pin and said flange have confronting chamfered edges which interengage upon the snap-locking engagement.

17. The sprayer according to claim 12, wherein said locking means comprise a pair of opposed, laterally extending lock pins resiliently connected to said cover respectively for snap-lock engagement with a pair of laterally extending openings in flanges on said housing.

18. The sprayer according to claim 17, wherein said lock pins project beyond respective outer surfaces of said flanges in said closed position permitting disengagement with said openings upon application of inward finger pressure applied to said pins.

19. The sprayer according to claim 18, wherein said pins and said flanges have respective confronting chamfered edges which respectively interengage upon the snap-locking engagement.

20. The sprayer according to claim 12, further comprising a cylindrical sidewall extending upstream from said end wall and defining a nosepiece together therewith, a laterally extending circular seal ring on said nosepiece concentric with said orifice, and means on said cover in sealing engagement with said seal ring in said closed position for sealing the discharge orifice closed.

21. The sprayer according to claim 20, wherein said seal ring comprises an annular downstream extending chevron seal diverging outwardly of said nosepiece.

22. The sprayer according to claim 20, wherein said means on said cover comprises a cylindrical sidewall which telescopes over said nosepiece in said closed position.

23. The sprayer according to claim 22, wherein said means on said cover further comprises a bottom wall of said cover sidewall spaced from said orifice in said closed position.

* * * * *

US005706983B1

REEXAMINATION CERTIFICATE (3852nd)

United States Patent [19] [11] B1 5,706,983

Dobbs et al. [45] Certificate Issued Aug. 24, 1999

[54] TRIGGER SPRAYER HAVING A NOZZLE COVER

[75] Inventors: Douglas B. Dobbs, Yorba Linda; Adonis K. Spathias, Corona, both of Calif.

[73] Assignee: Calmar Inc., City of Industry, Calif.

Reexamination Request:
No. 90/004,967, Apr. 15, 1998

Reexamination Certificate for:

| | |
|---|---|
| Patent No.: | **5,706,983** |
| Issued: | **Jan. 13, 1998** |
| Appl. No.: | **08/516,559** |
| Filed: | **Aug. 18, 1995** |

[51] Int. Cl.[6] ..... B67B 5/00
[52] U.S. Cl. ..... 222/153.14; 222/136; 222/383.1
[58] Field of Search ..... 222/153.14, 135, 222/136, 137, 383.1, 556

[56] References Cited

U.S. PATENT DOCUMENTS

| | | |
|---|---|---|
| 4,230,277 | 10/1980 | Tada . |
| 4,911,361 | 3/1990 | Tada . |
| 5,560,545 | 10/1996 | Grogan et al. . |

*Primary Examiner*—Gregory L. Huson

[57] ABSTRACT

A trigger actuated pump sprayer has a nozzle cover for sealing the discharge orifice closed against leakage by the provision of a cup-shaped element on the cover which telescopes about a nosepiece in which the orifice is formed and fluid tightly engages a seal ring extending laterally outwardly of the nosepiece in the closed position of the cover. The cover is locked in its closed position and is rendered child-resistant by the provision of at least one resilient lock pin extending through an opening in the sprayer housing requiring an inward depression of the lock pin with one hand and a flipping open of the cover with the other hand.

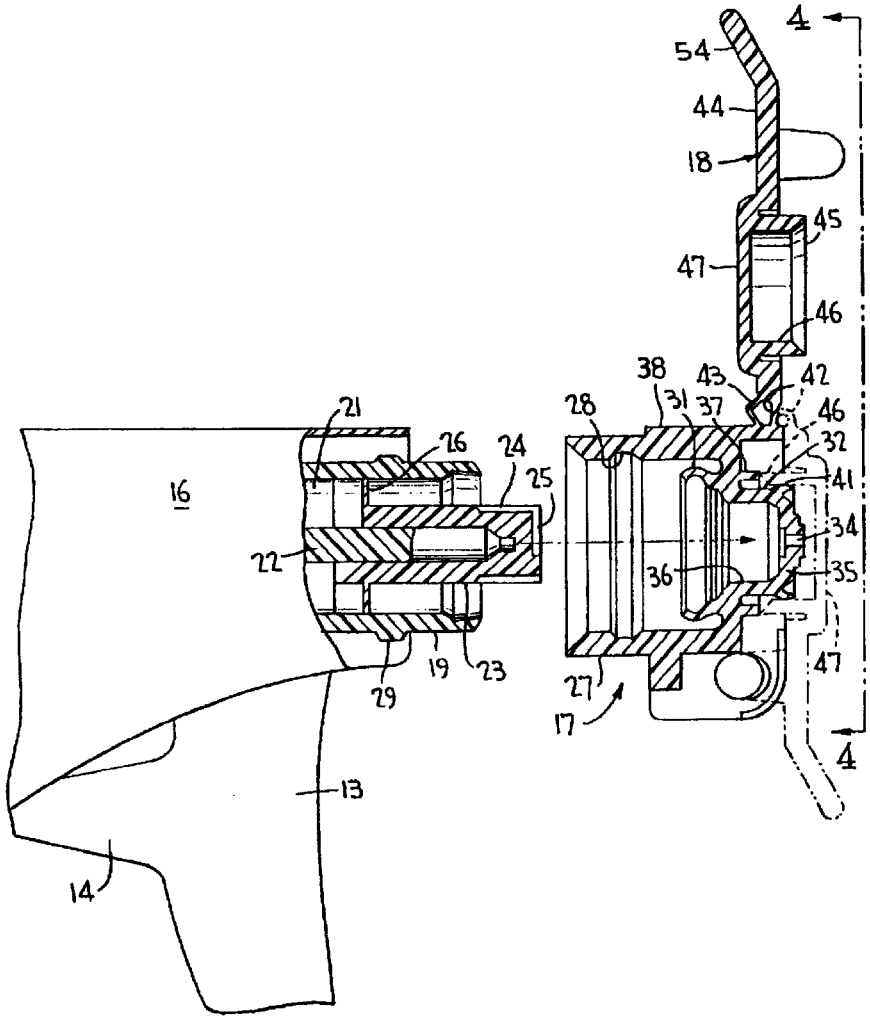

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–23 is confirmed.

* * * * *